US005540616A

United States Patent [19]

Thayer

[11] Patent Number: 5,540,616

[45] Date of Patent: Jul. 30, 1996

[54] VACUUM ATTACHMENT FOR A SANDER

[76] Inventor: Deane S. Thayer, P.O. Box 1466, Dennisport, Mass. 02639

[21] Appl. No.: 267,352

[22] Filed: Jun. 29, 1994

[51] Int. Cl.[6] ..... B24B 23/00; B24B 55/06

[52] U.S. Cl. ..... 451/354; 451/456

[58] Field of Search ..... 451/354, 456, 451/523, 524, 525, 359

[56] References Cited

U.S. PATENT DOCUMENTS

| | | | |
|---|---|---|---|
| 4,062,152 | 12/1977 | Mehrer | 451/456 |
| 4,680,895 | 7/1987 | Roestenberg | 451/359 |
| 4,697,389 | 10/1987 | Romine | 451/354 |
| 4,765,099 | 8/1988 | Tanner | 451/359 |
| 4,779,385 | 10/1988 | Reiter | 451/456 |
| 4,782,632 | 11/1988 | Matechuk | 451/354 |
| 4,937,984 | 7/1990 | Taranto | 451/354 |
| 4,964,243 | 10/1990 | Reiter | 451/354 |
| 5,036,627 | 8/1991 | Walters | 451/354 |
| 5,193,313 | 3/1993 | Sanchez et al. | 451/456 |
| 5,239,783 | 8/1993 | Matechuk | 451/354 |

*Primary Examiner*—Bruce M. Kisliuk
*Assistant Examiner*—Dona C. Edwards
*Attorney, Agent, or Firm*—Michael I. Kroll

[57] ABSTRACT

A device that is intended as a snap on attachment for an existing pole-mounted sander. Snap-fit receiving elements are attached to the poleward side of the generally rectangular and planar abrasive receiving surface and the pole itself is slid through and retained against lateral movement by a central rigid collar. This then brings a substantially rigid mouth portion that is configured to extend about the periphery of the receiving surface, and that also carries upon it the protruding snap members, into a proximal relationship with the abrasive receiving surface whereby the mutually engageable snap members hold the present invention in place to form a continuous intake port. A flexible collar portion lies between the mouth portion and the rigid collar portion to allow for tilting of the abrasive surface during use, as is common on the pole mounted sanders currently in use. A pair of soft, clear hoses lead out from the mouth portion, meet at a "Y" junction, and then are attached to the remainder of the pole by adjustable collars or the like, eventually leading to a conventional vacuum cleaner adapter.

3 Claims, 3 Drawing Sheets

VACUUM ATTACHMENT FOR A SANDER

BACKGROUND OF THE INVENTION

1. Field of the Invention

The current invention relates to vacuum attachments for abrasive tools and the like. More specifically, it relates to a vacuum attachment for a sanding pad. Even more specifically, it relates to a snap-on vacuum attachment for a sander attached to an extended pole for the sanding of remote or hard to reach areas, such as ceilings and the like.

More broadly, the invention could also find use in combination with any general purpose tool for remotely dislodging and removing debris from any difficult to reach external or internal surface such as within a blind hole. As such the potential fields of use are myriad. Removing corrosion from exposed ship surfaces and asbestos fibers from within building walls and duct work are two examples that come to mind. Those skillful in the mechanical arts will find many other potential fields of use for this device. It is to be understood from the outset that the scope of this invention is not limited to these fields or to the specific examples of potential uses presented hereinafter.

2. Description of the Prior Art

When sanding areas such as ceilings expanses of drywall or the like, one of the more annoying by-products of the process is the dispersion of the fine particles dislodged by the manipulated abrasive. These particles are dispersed throughout the ambient atmosphere and over the surrounding area and have to be cleaned up before the job is done. Not only is this time consuming, but it also constitutes a health hazard, in some cases requiring the use of respirators. The present invention serves to obviate this problem, however first the discussion turns to previous patents that have addressed similar concerns. A number of prior art patents have been issued that address this problem.

In U.S. Pat. No. 4,765,099 issued on Aug. 23, 1988 to John G. Yanner there is disclosed a sanding and dust collecting apparatus. A housing assembly is attachable to and supported by a pneumatic sander. An impeller blade creates a vortex-like suction and thereby propels the particulate matter generated by the sander towards a collection bag.

Next is U.S. Pat. No. 4,937,984 issued on Jul. 3, 1990 to Thomas F. Taranto. This discloses a vacuum sander wherein a housing that forms a vacuum manifold communicating with an abrasive sheet at one end, the sheet being supported by a air permeable foam pad. Both a hand held and a handle-held embodiment are described and it is explained that the source of the vacuum could be a standard household vacuum cleaner or the like.

U.S. Pat. No. 4,680,895 issued on Jul. 21, 1987 to Jerome R. Roestenberg there is disclosed a block sander vacuum wherein a plurality of ports are disposed proximate a removably attached abrasive surface. These ports are connected to a coupling means for connection with a conventional vacuum cleaner. Additionally, on opposite sides of the body of the device are disposed depending skirts to aid in the collection and directing of the particulate matter generated by the sanding process.

Next in this discussion is U.S. Pat. No. 4,779,385 issued on Oct. 25, 1988 to John P. Reiter. A gypsum board sanding apparatus is described wherein a paddle adapted to support a sheet of sandpaper includes a plurality of apertures both through and about it to allow for the passage of air and dust particles into a plenum that is connected to a conventional vacuum cleaner.

Lastly, U.S. Pat. No. 4,964,243 issued on Oct. 23, 1990, also to John P. Reiter discloses a vacuum pole sander. A sanding head includes a number of pedestals for supporting the abrasive material. The head member is configured to be attached to a universal joint and, thus, to a pole for sanding hard to reach areas.

Although certain similarities between the prior patents, directed generally toward solving the aforementioned problem, and the instant invention are seen to exist, it is believed the unique novel features and improvements herein rise to the level of patentable distinction. For example, none of the prior art is suitable for use as an conversion kit which converts an existing pole sander into a fully functional vacuum removal sander.

None of the above inventions and patents, taken either singly or in combination, is seen to describe the instant invention as herein claimed.

SUMMARY OF THE INVENTION

The present invention is a device that is intended as a snap on attachment for an existing pole-mounted sander. Snap-fit receiving elements are attached to the poleward side of the generally rectangular and planar abrasive receiving surface and the pole itself is slid through and retained against lateral movement by a central rigid collar. This then brings a substantially rigid mouth portion that is configured to extend about the periphery of the receiving surface, and that also carries upon it the protruding snap members, into a proximal relationship with the abrasive receiving surface whereby the mutually engageable snap members hold the present invention in place. A flexible collar portion lies between the mouth portion and the rigid collar portion to allow for tilting of the abrasive surface during use, as is common on the pole mounted sanders currently in use. A pair of soft, clear hoses lead out from the mouth portion, meet at a "Y" junction, and then are attached to the remainder of the pole by adjustable collars or the like, eventually leading to a conventional vacuum cleaner adapter.

Accordingly, it is a principal object of the invention to provide a vacuum sanding attachment that can easily be attached and detached from a conventional pole mounted, tiltable sander head.

It is another object of the invention to provide a vacuum sanding attachment wherein the dust and particulate matter generated by the sanding action is collected about the periphery of the tiltable sanding head.

It is a further object of the invention to provide a vacuum sanding attachment wherein the collecting portion of the device can be movably adjusted to allow for various complementing placements thereof depending on the current collection needs.

It is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the above drawings and the following detailed description. The reader may find it useful to refer to the numerical list of elements of the invention appearing an the end of the detailed description.

DETAILED DESCRIPTION OF THE PREFERRED EMBODIMENT

The present invention is generally indicated at 1. This is a conversion kit device that is adapted to fit on a commonly available pole mounted sanding implement 5 and thus transform the implement into a fully functional sanding and vacuum cleaning device. Conventional pole mounted sanding implements consist of an elongate pole 2, an abrasive receiving surface 3, and are also commonly provided with a tilting mechanism 4.

Figure 2:
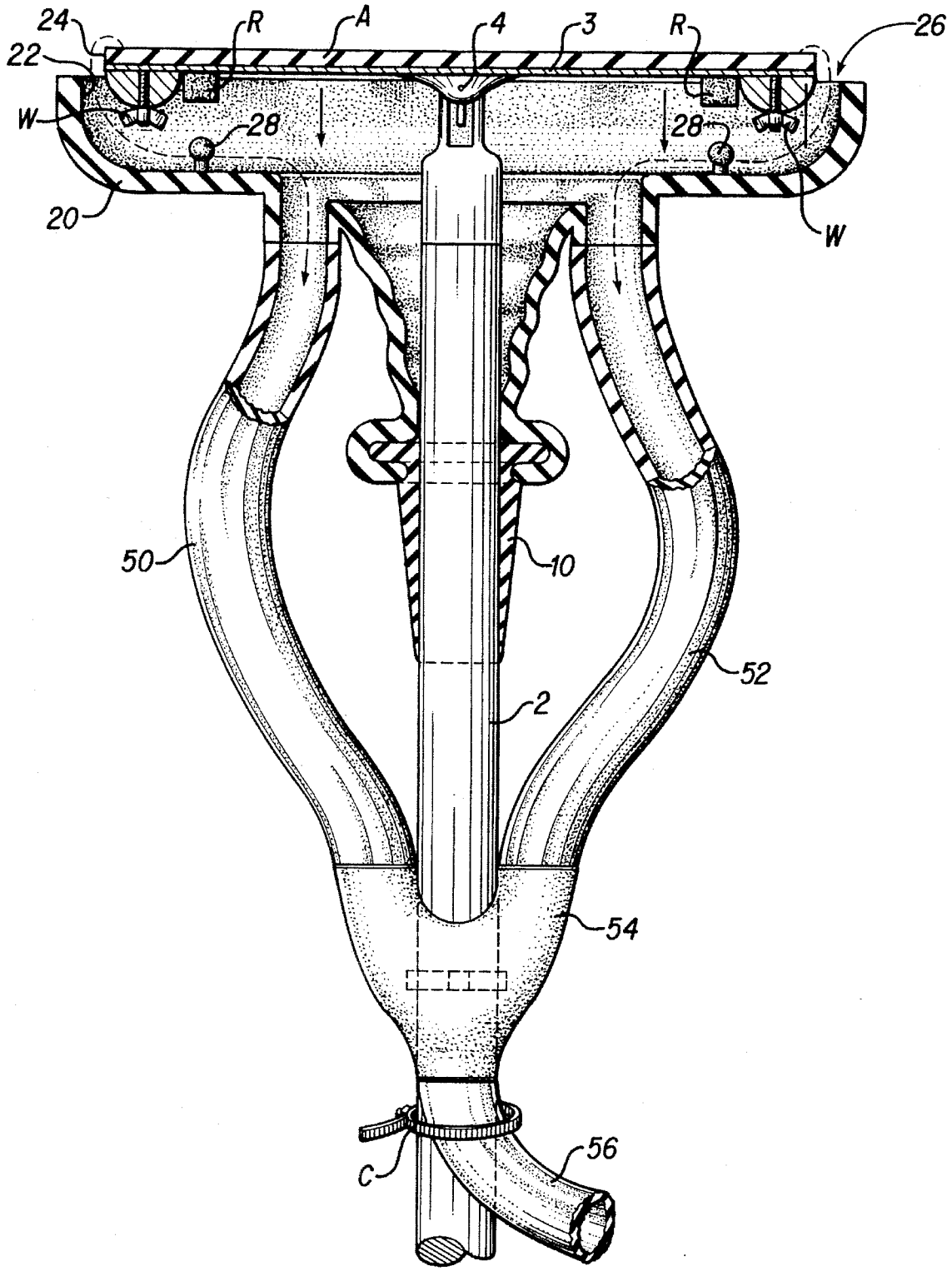
FIG. 2 is a front, partial cutaway view of the present invention.
Figure 3:
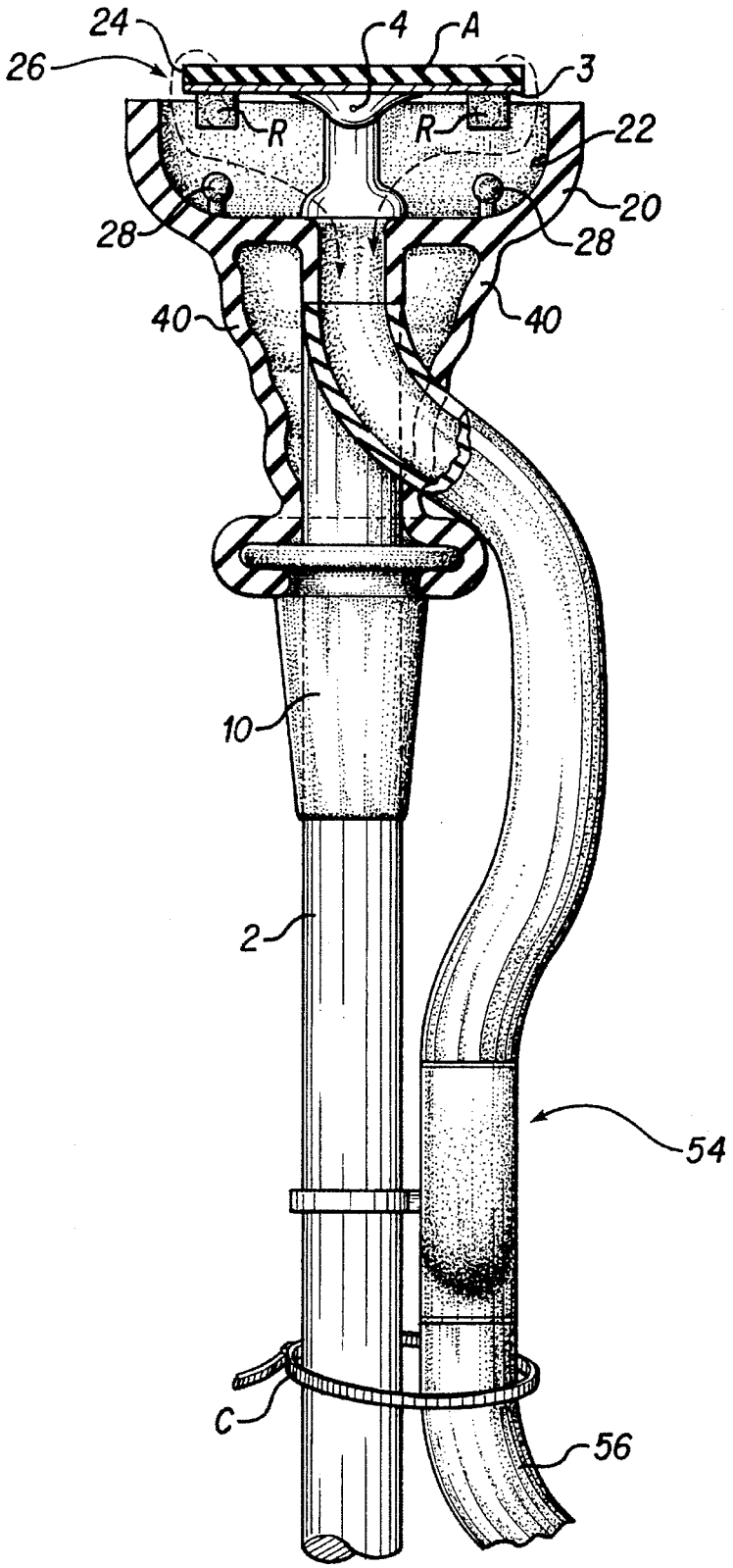
FIG. 3 is a side, partial cutaway view.

Tilting mechanism 4, seen in FIGS. 2 and 3, is for the purpose of allowing a flat abrasive sheet A to more or less freely assume any angle with respect to the pole 2. The artisan will recognize that tilting mechanism 4 is only exemplary and that any suitable means of achieving the described pivoting action could be employed. It is also noted that the elongate pole 2 could be made telescopic so as to accommodate a wide range of reach without in any way interfering with the conversion kit capabilities of this invention.

As shown in FIG. 2, many of these commonly available pole mounted sanding implements also include wing nuts W that allow an abrasive sheet A to be removably secured to the abrasive receiving surface 3. The routinist will recognize that the flat abrasive receiving surface 3 could be shaped and curved in any manner so as to conform the abrasive sheet A to any complementary shaped surface to be cleaned. These are all common art features and, as they have no specific bearing on the present invention, they will not be discussed in further detail.

This discussion will first turn to the retaining and mouth portion of the device: that is the parts of the apparatus that first, receive and retain the pole mounted sander and secondly, the parts that direct the incoming flow of air with the entrained dust and particulate matter that it contains towards the hoses leading to the conventional vacuum cleaner. It should be understood that though "conventional vacuum cleaner" is the term used throughout this discussion, this refers to not only the standard household cleaning type unit that is common in almost every home in the West, but also includes the more powerful commercial type units used in workshops and the like which are not only more powerful, but are able to tolerate entrained moisture in the airstream that they produce.

Figure 1:
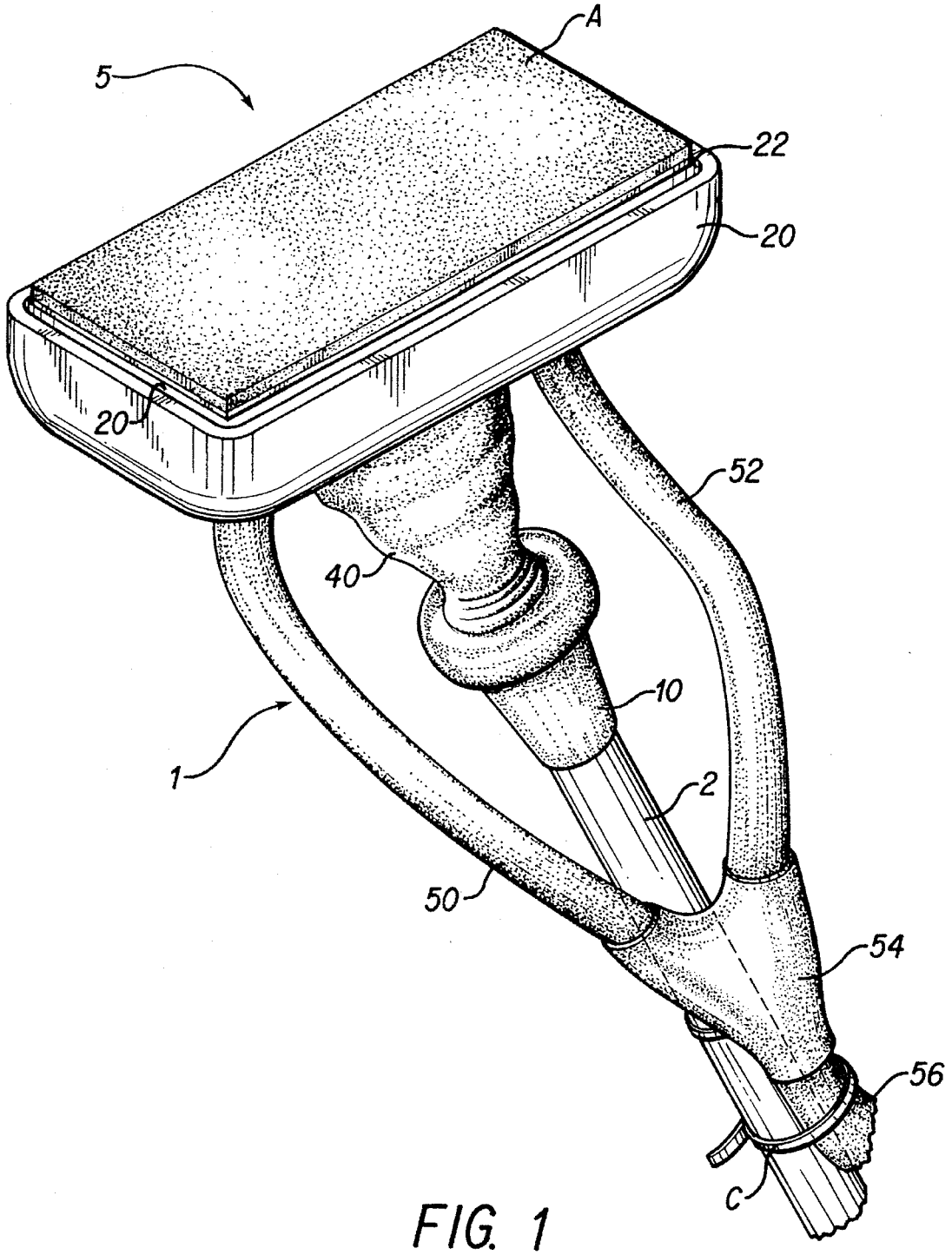
FIG. 1 is an environmental perspective view of the present invention.

The device has a rigid collar portion 10 that is configured to receive a pole 2 having a diameter that is commonly used in the sanders under discussion. There is a mouth portion 20 that, as can be seen from in FIGS. 1 and 3, has an inner periphery 22 that is larger than the outer periphery 24 of the abrasive receiving surface 3 to create a continuous intake port 26 extending about the abrasive receiving surface 3 and the attached abrasive sheet A. Referring to FIGS. 2 and 3 there are included in the apparatus a number of attachable snap receivers R. It is contemplated that these snap receivers R would be packaged separately from the rest of the apparatus and would be attachable to the abrasive receiving surface 3 such that the protruding snap members 28 would engage therewith, thus holding the present invention 1 and the sanding implement 5 in a substantially fixed relationship. The number of snap receivers R and protruding snap members 28 is not fixed herein, however four are contemplated, being placed proximate the corners of the abrasive receiving surface 3. Nor is it fixed how the receiving members R would be attached to surface 3, however an adhesive could be used, as could hook and loop type fasteners, or another type of attachment means. Both the rigid collar 10 and the mouth portion 20 are made from a material that allows a minimal amount of flex. Any number of plastics are contemplated for this purpose. Spanning the area between the collar 10 and the mouth portion 20 is a loose, flexible member 40 that allows for the tilting movement of the abrasive receiving surface 3 in relation to the attached pole 2 without displacement from the former by mouth portion 20.

The discussion now turns to the hose assemblies used in the device. Attached to the mouth portion 20 are a pair of hoses 50, 52. As in the case of the flexible member 40, it is preferable that the hoses are made of a flexible material to allow for the tilting of the abrasive receiving surface 3, as discussed above. It is also contemplated that the hoses be made of a substantially transparent material to allow the user to ascertain if accidental or inadvertent blockage is present within them. Hoses 50 and 52 meet at a Y-joint member 54. A single hose 56 leads from the Y-joint member 54 and goes to a otherwise conventional vacuum cleaner (not shown). The hose 56 would be connected to the vacuum cleaner by an adaptor (also not shown). These adapters are well known in the art, and it is not deemed necessary to illustrate or elaborate on such well known items. The hose 56 is held in a proximate relationship to the pole 2 by an adjustable collar or collars C. These collars C can be placed wherever the user desires to allow for simplified grasping and manipulation of the unit. Shown in the figures is a type of collar C well known in the art for retaining bundles of electrical cable or the like together, however other types of collars, or even an elastic could be used, as long it is understood that the collar must be removable and adjustable to allow for breakage of the pole sander, heights and sizes of different users, and the completion of the job, where it would be desirable to detach the present invention from the sander.

Thus, in use, the snap receivers R would be placed on the side of the abrasive receiving surface 3 opposite the side thereof that engages the abrasive sheet A. The elongate pole 2 of the sanding implement 5 is then slid into and retained by the rigid collar 10. The mouth portion 20 with the protruding snap members 28, engaging the snap receivers R, then forms the continuous intake port about the abrasive sheet A. The device is then attached to a conventional vacuum cleaner (not shown). The user is then able to sand ceilings or drywall before finishing, without having to worry about the dust and particulate matter covering the furniture and floor, contaminating foodstuffs or utensils, and the use of respirators, masks, or the like is obviated. The clips C can be moved and tightened in whatever location along the pole 2 that the user desires as circumstances on the job change.

Following hereafter is a list of the elements set out in this specification:

| | |
|---|---|
| present invention | 1 |
| sanding implement | 5 |
| elongate pole | 2 |
| abrasive receiving surface | 3 |
| tilting mechanism | 4 |
| wing nuts | W |
| abrasive sheet | A |
| rigid collar portion | 10 |
| mouth portion | 20 |
| inner periphery | 22 |
| outer periphery | 24 |
| continuous intake port | 26 |
| snap receivers | R |
| protruding snap members | 28 |
| flexible member | 40 |
| hose | 50 |
| hose | 52 |
| Y-joint member | 54 |
| single hose | 56 |
| adjustable, removable collar | C |

It is to be understood that the present invention is not limited to the sole embodiment described above, but encompasses any and all embodiments within the scope of the following claims.

I claim:

1. Vacuuming sanding apparatus comprising:

a) an elongated pole and an extended member with an abrasive receiving surface on one side pivotally mounted on one end of said pole with said receiving surface on the side of said member opposite that of said pole;

b) an abrasive sanding sheet removably mounted on said receiving surface;

c) open mouth means having a rigid collar slidably mounted on said pole and an open mouth portion surrounding said extended member on which said abrasive sanding sheet is mounted and forming a continuous intake port surrounding the periphery of said abrasive sanding sheet and a chamber below said extended member, and flexible means surrounding said pole and joining said collar to said open mouth portion to permit said open mouth to move with and accommodate the pivoting of said extended member;

d) snap means comprising a plurality of snap members mounted within said open mouth means protruding toward said extended member parallel to the length of and surrounding said pole;

e) snap receiving means mounted on said extended member on the same side where said pole is pivotally connected to said extended member and aligned with said snap members permitting said collar to slide down said pole until said snap members engage said snap receiving means so that said abrasive sanding sheet and said open mouth portion can pivot together as needed while sanding and permitting said collar to slide up said pole to disengage said snap members from said snap receiving means removing said open mouth member from said extended member to allow the removal and replacement of said abrasive sanding sheet; and f) flexible conduit means connecting said open mouth means and communicating with said chamber below said extended member extending down said pole for communicating with a source of vacuum, allowing waste products generated while sanding to be removed through said intake port, said chamber and said conduit means for proper disposal.

2. The vacuuming apparatus as claimed in claim 1, wherein said conduit means is a pair of flexible hoses.

3. The vacuuming apparatus according to claim 2, wherein said pair of flexible hoses are joined at a Y-joint end for attachment to said pole such that a single flexible hose remains in fluid communication with said continuous intake port.

* * * * *